US005791556A

United States Patent [19]

Hawkins

[11] Patent Number: 5,791,556

[45] Date of Patent: Aug. 11, 1998

[54] EASY OPENING ENVELOPE

[76] Inventor: Michael R. Hawkins, 406 E. Margarita Rd., Rialto, Calif. 92376

[21] Appl. No.: 879,671

[22] Filed: Jun. 23, 1997

Related U.S. Application Data

[63] Continuation of Ser. No. 590,369, Jan. 24, 1996, abandoned.

[51] Int. Cl.[6] ..... B65D 27/34; B65D 27/36

[52] U.S. Cl. ..... 229/313; 229/75; 229/80; 229/81; 229/306

[58] Field of Search ..... 229/75, 80, 81, 229/306, 309, 310, 311, 312, 313

[56] References Cited

U.S. PATENT DOCUMENTS

| | | | |
|---|---|---|---|
| 286,881 | 10/1883 | Weaver | 229/75 |
| 754,201 | 3/1904 | Davalos | 229/313 |
| 877,330 | 1/1908 | Harvey | 229/306 |
| 895,520 | 8/1908 | Virkus | 229/306 |
| 1,550,750 | 8/1925 | Shannon | 229/311 |
| 2,021,620 | 11/1935 | Weir | 229/75 |
| 2,087,410 | 7/1937 | Lane et al. | 229/80 |
| 2,092,149 | 9/1937 | Berkowitz | 229/80 |
| 2,310,371 | 2/1943 | Liner et al. | 229/313 |
| 2,527,925 | 10/1950 | Frampton | 229/306 |
| 2,859,907 | 11/1958 | McFarland | 229/313 |
| 3,190,540 | 6/1965 | Shade | 229/313 |
| 3,392,905 | 7/1968 | Caldwell | 229/313 |
| 3,650,463 | 3/1972 | Christiansen et al. | 229/81 |
| 3,853,262 | 12/1974 | Tucker et al. | 229/80 |
| 3,888,408 | 6/1975 | Clipner | 229/85 |
| 4,166,538 | 9/1979 | Nixon et al. | 206/628 |
| 4,166,539 | 9/1979 | Allen et al. | 206/629 |
| 4,470,511 | 9/1984 | Meeker et al. | 206/610 |
| 4,819,807 | 4/1989 | Giger | 229/313 |
| 5,163,612 | 11/1992 | Ashby | 229/301 |

FOREIGN PATENT DOCUMENTS

| | | | |
|---|---|---|---|
| 492399 | 9/1938 | United Kingdom | 229/80 |
| 510989 | 8/1939 | United Kingdom | 229/313 |

*Primary Examiner*—Stephen P. Garbe
*Attorney, Agent, or Firm*—Loeb & Loeb LLP

[57] ABSTRACT

An envelope has a self-opening tear strip with a pull-tab at about the middle of a side edge. The pull-tab is conveniently grasped and the contents of the envelope are readily accessible upon opening.

29 Claims, 5 Drawing Sheets

EASY OPENING ENVELOPE

This is a continuation of application Ser. No. 08/590,369 filed on Jan. 24, 1996, now abandoned.

BACKGROUND OF THE INVENTION

An envelope is a container, usually made of folded paper, which is designed to enclose documents or other substantially flat objects for the purpose of keeping these contents together and preventing their inspection by others during transmission to a recipient. The most commonly used envelopes, such as the COM-10 business envelope, are made of a single sheet of paper folded along four lines to form a front panel, side flaps, a back panel, and a closure flap. The side flaps are adhesively secured to the back panel. A sealing edge on the interior surface of the closure flap is usually provided with adhesive for the purpose of sealing the closure flap to the back panel after the envelope has received its contents in the pocket formed by the front panel, side flaps, and back panel.

This design of envelope is simple and inexpensive. The procedures for removing the contents of an envelope of this design, however, usually involve cutting or tearing the closure flap or other portions of the envelope, separating the front panel from the back panel, and reaching inside to remove the contents.

Envelopes have been provided with tear strips, perforations or other self-opening means to facilitate access to the contents of the envelopes. Examples of self-opening means are disclosed in U.S. Pat. No. 3,650,463 to Christiansen et al. and U.S. Pat. No. 4,166,539 to Allen et al. Envelopes have also been provided with opening means that provide improved access to the contents of the envelopes. Examples of such opening means are disclosed in U.S. Pat. No. 5,163,612 to Ashby, U.S. Pat. No. 4,470,511 to Meeker et al., and U.S. Pat. No. 4,166,538 to Nixon et al.

Existing self-opening means for envelopes can be difficult to use, particularly by the elderly or those persons without fingernails, because such means often require the user to grasp a pull-tab or tear strip located at the top of the envelope or in another location where the pull-tab or tear strip may not be conveniently grasped.

A need exists for an envelope that has self-opening means situated so as be readily accessible to the user. Such an envelope should also be designed to facilitate removal of the contents of the envelope and should be easy and economical to assemble and durable in construction.

SUMMARY OF THE INVENTION

My invention provides an envelope with self-opening means that are easy to use and facilitate the removal of the contents of the envelope. The envelope is constructed from a single sheet or blank of foldable material comprising at least four, and preferably five, panels or flaps.

An embodiment of the easy-opening envelope according to my invention comprises a substantially rectangular planar front panel having opposed inner and outer surfaces, a top edge, a bottom edge, and first and second opposed side edges. The front panel has first and second side flaps (the second side flap is optional) hingedly connected respectively to the first and second side edges of the front panel, the first and second side flaps each having an inner and an outer surface, and the inner surfaces of the first and second side flaps abutting the inner surface of the front panel. A back panel has opposed inner and outer surfaces, a bottom edge, a top edge, and first and second opposed side edges adjacent, respectively, to the first and second side edges of the front panel, the bottom edge of the back panel being hingedly connected to the bottom edge of the front panel, the inner surface of the back panel being adhesively attached to the outer surfaces of the first and second side flaps respectively (or to the front panel if the second side flap is omitted), the top edge of the front preferably panel extending above the top edge of the back panel on the first side edge of the back panel by a distance in the range of about three times to about one third of the height of the back panel when the back panel is adhesively fastened to the first and second side flaps. The back panel has a line of perforations parallel to and below the top edge of the back panel. A closure flap has opposed inner and outer surfaces, a side edge adjacent the first side edge of the front panel, a top edge hingedly connected to the top edge of the front panel, a sealing edge, and a line of perforations parallel to the sealing edge and coincident with or above the top edge of the back panel when the closure flap is in sealing engagement with the back panel, the distance from the top edge of the closure flap to the sealing edge of the closure flap being such that the closure flap may be sealed to the back panel above the line of perforations in the back panel, the portions of the closure flap and the back panel in sealing engagement between the lines of perforations thereby forming a mated tear strip for opening the envelope after sealing.

The sealing edge of the closure flap may slant upwardly (or downwardly) from the first side edge of the front panel when the envelope is viewed from the back, in which case the top edge of the back panel also slants upwardly (or downwardly) so that the closure flap and the back panel can be sealingly engaged. Alternatively, the sealing edge of the closure flap and the top edge of the back panel may be parallel to the top edge and the bottom edge of the front panel.

The closure flap or the back panel may be provided with engagement tabs or cut to form free pull-tabs to permit the user to easily grasp the mated tear strip in order to open the envelope. The envelope can be flexed or bowed so that it is convex towards its back side by squeezing the top side and the bottom side of the front panel with one hand while grasping the engagement tab or free pull-tab with the other hand in order to open the envelope. The contents of the envelope are readily removed because part of the contents will be exposed when the closure flap is folded upwards.

The closure flap and the back panel can be sealingly engaged with either the closure overlapping the back panel or vice versa.

The tear strip can also be formed exclusively in the closure flap or in the back panel as long as the engagement tab or free pull-tab is located no closer to the top edge or the bottom edge of the front panel than about one quarter of the vertical distance between the top edge and the bottom edge of the front panel.

The invention will be explained in detail below by description of preferred and alternative embodiments.

DETAILED DESCRIPTION OF THE PREFERRED EMBODIMENT

Figure 1:
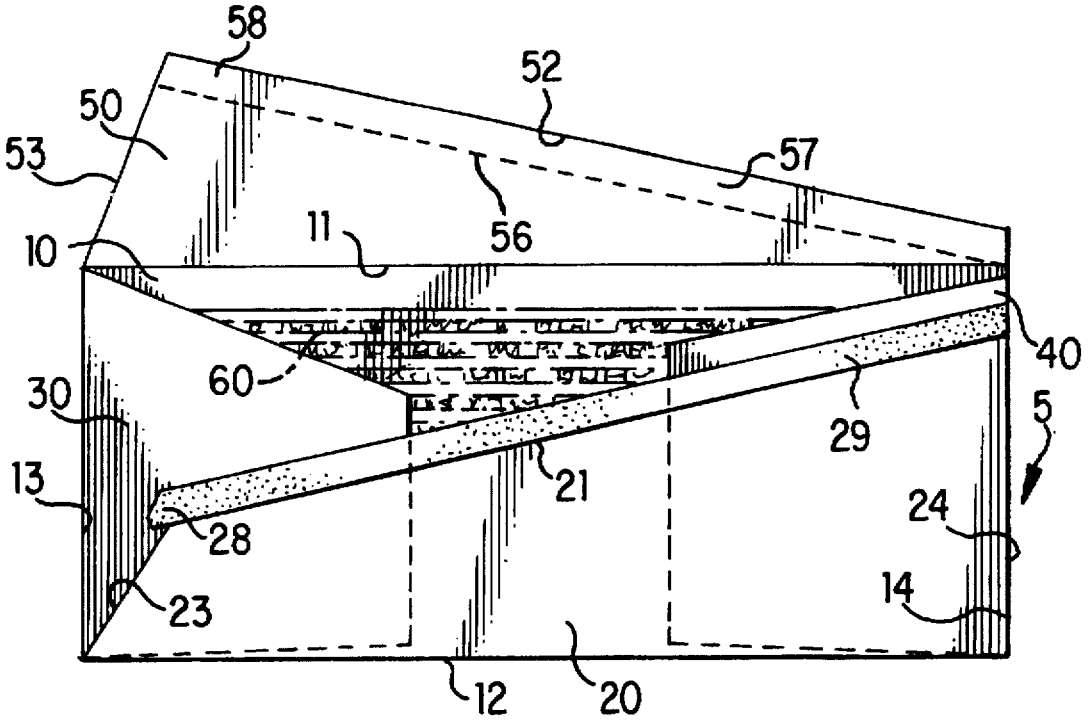
FIG. 1 is a plan view of a preferred embodiment of the subject envelope viewed from the back with the closure flap in the open position.

Referring to FIG. 1, the easy opening envelope of the subject invention is indicated generally by reference number 5. Envelope 5 is constructed from a blank cut or punched from a single sheet of flat material such as paper or other material suitable for making envelopes. The blank is folded to form several panels or flaps.

In FIG. 1 back panel 20, side flaps 30 and 40 (the side flap 40 is largely hidden by the back panel 20 in FIG. 1), and closure flap 50 may be seen. The front panel 10 is largely hidden from view in FIG. 1 by the contained document 60 which does not form part of the subject invention and is indicated in phantom. The side flaps 30 and 40 are folded along first side edge 13 and second side edge 14 of the front panel, respectively, so that the interiors of the side flaps 30 and 40 are adjacent the interior of the front panel 10 (and separated only by the contained document 60). The back panel 20 is folded along the bottom edge 12 of the front panel 10 so that the interior surface of the back panel 20 contacts the outer surfaces of the side flaps 30 and 40. The side flaps 30 and 40 are adhered to the back panel 20, thus forming a pocket for enclosing the documents or other contents to be placed in the envelope 5.

The side flap 40 may be omitted to save paper, in which case the front panel 10 may be adhered directly to the back panel 20 in the vicinity of their respective second side edges 14 and 24.

Figure 2:
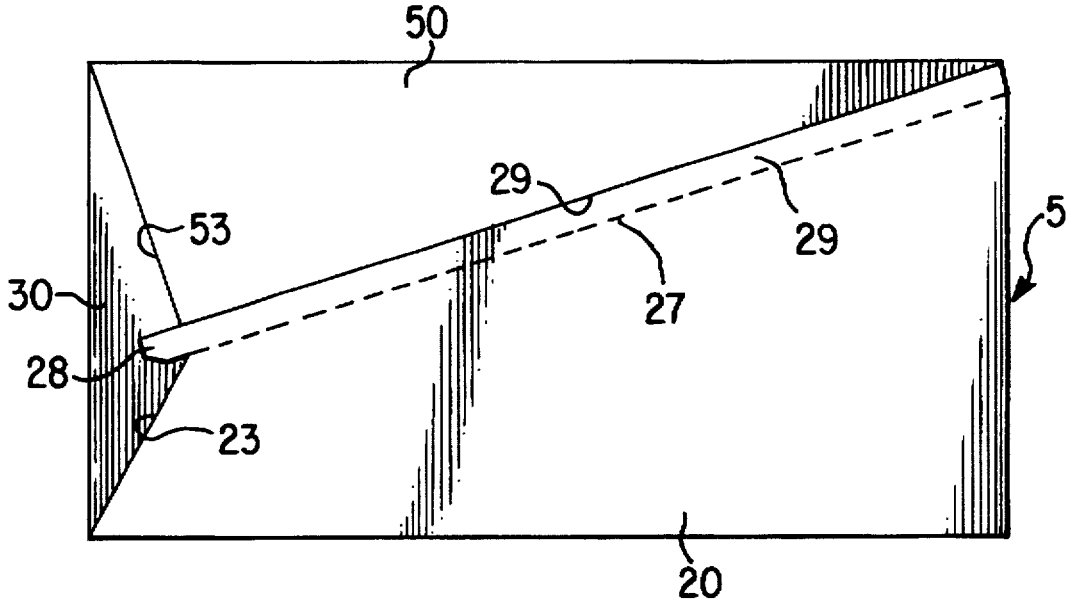
FIG. 2 is a plan view of the same preferred embodiment of the subject envelope viewed from the back with the closure flap in the closed position.

The top edge 21 of the back panel 20 slants upwardly from the first side edge 23 of the back panel 20 to the second side edge 24 of the back panel 20. The sealing edge 52 of the closure flap 50 has a corresponding slant so that it will be overlapped by the top edge 21 of the back panel 20 when the envelope 5 is sealed, as is shown in FIG. 2.

A line of perforations 27 parallels the top edge 21 of the back panel 20. Similarly, a line of perforations 56 parallels the sealing edge 52 of the closure flap 50. The portion of the back panel 20 that is located between the line of perforations 27 and the top edge 21 comprises a first tear strip 29 that is provided with adhesive for sealing engagement with the closure flap 50 in order to seal the envelope 5. The first tear strip 29 is shown folded down against the rest of back panel 20 in FIG. 1, and folded up and over closure flap 50 in FIG. 2. The types of adhesive that may be applied to the inner surface of the first tear strip 29 are well known to those of ordinary skill in the art.

The envelope 5 is sealed by folding the closure flap 50 downwards and then overlapping the sealing edge 52 of the closure flap 50 with the first tear strip 29. The first tear strip 29 contacts that portion of the back panel 50 between the line of perforations 56 and the sealing edge 52 and forms a sealing engagement with it. The portion of the closure flap 50 that is between the line of perforations 56 and the sealing edge 52 comprises the second tear strip 57. The first tear strip 29 and the second tear strip 57 form a mated tear strip when the closure flap 50 is in sealing engagement with the back panel 20.

The first tear strip 29 has an extension tab 28 formed integrally with it above the intersection of the line of perforations 27 with the first side edge 23 of the back panel 20. (Alternatively, or in addition, an extension tab may be formed integrally with the second tear strip 57 below the intersection of the line of perforations 56 and the side edge 53 of the closure flap 50.) The envelope 5 may be opened by grasping the extension tab 28 and pulling in the general direction of the second side edge 24 of the back panel 20. The first tear strip 29 and the second tear strip 57 will detach from the back panel 20 and the closure flap 50, respectively, thus opening the envelope 5. The opening of the envelope may be facilitated by cutting a short distance along the lines of perforations 27 and 56 where those lines of perforations intersect with the first side edge 23 of the back panel 20 and the side edge 53 of the closure flap 50, respectively. Furthermore, a free pull-tab can be created by so cutting these portions of the lines of perforations 27 and 56, in which case a projecting extension tab 28 is not required.

Figure 4:
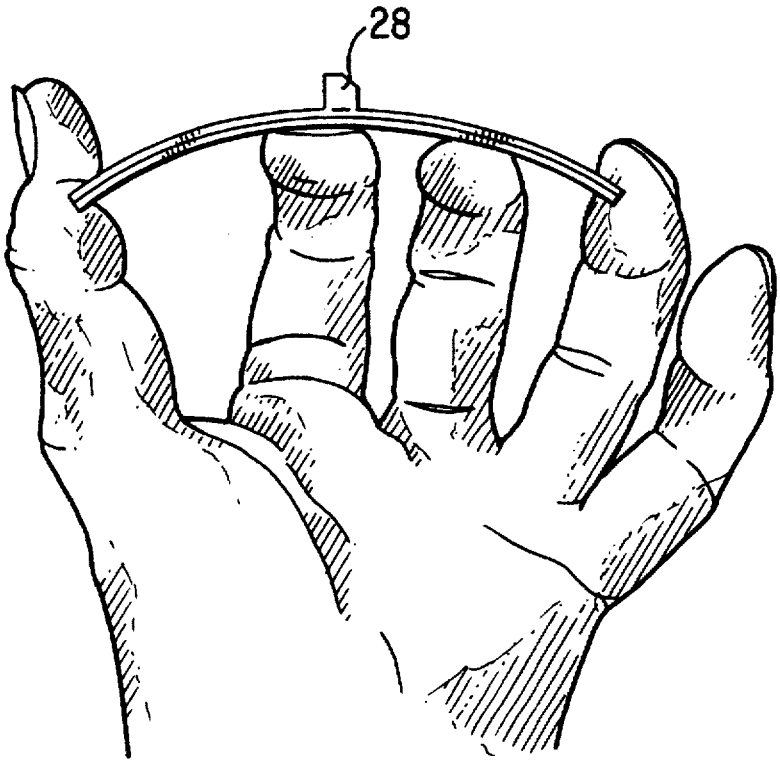
FIG. 4 is a side perspective view of the same preferred embodiment of the subject envelope showing how the envelope may be flexed to render the pull-tab accessible.
Figure 5A:
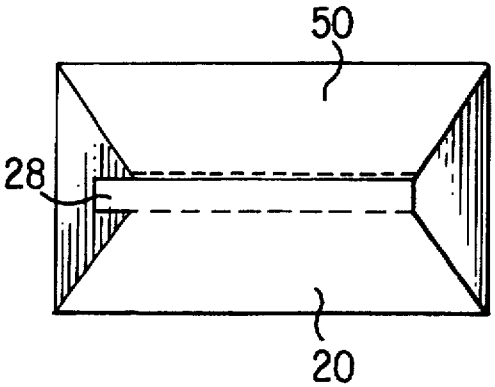
FIGS. 5a–5i are plan views of alternative embodiments of the envelope of the invention.
Figure 5B:
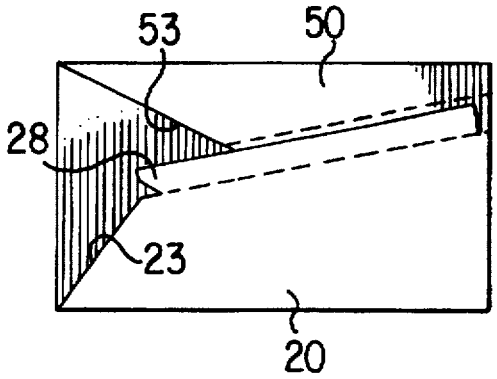
Figure 5C:
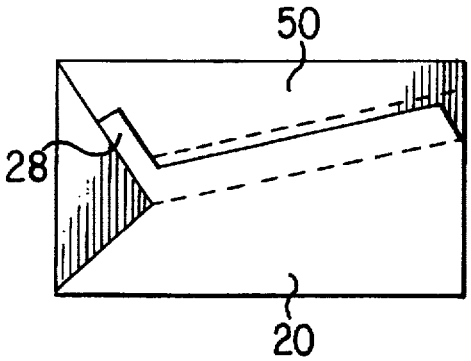
Figure 5D:
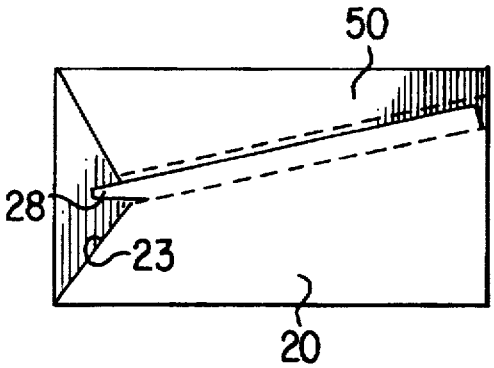
Figure 5E:
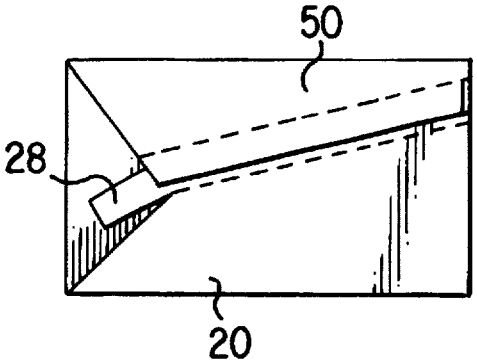
Figure 5F:
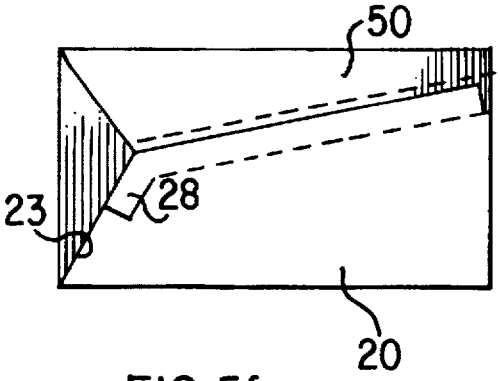
Figure 5G:
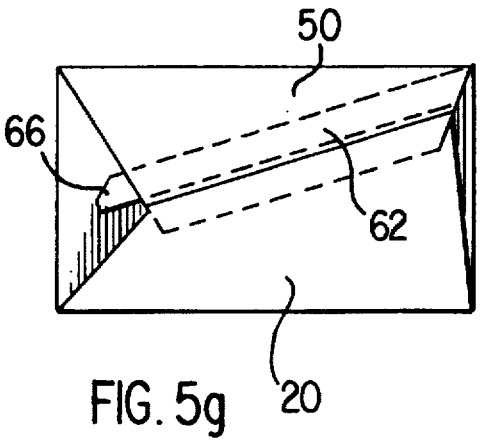
Figure 5H:
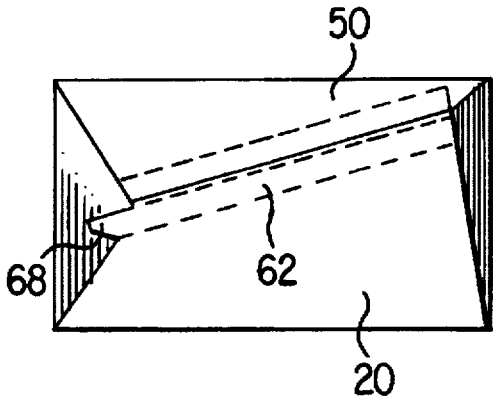
Figure 5I:
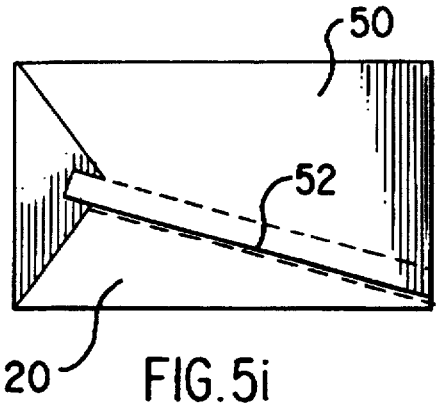

The extension tab 28 of the first tear strip 29 and the end 58 of the second tear strip 57, which are adjacent the first side edge 13 of the front panel 10 and intersect with the first side edge 23 of the back panel 20 and the side edge 53 of the closure flap 50, are located approximately half way between the top edge 11 and the bottom edge 12 of the front panel 10. This location has at least two purposes. First, the extension tab 28 (or free pull-tab if an extension tab is omitted) may be readily grasped by the user with the index finger and thumb of one hand while bending the envelope upwardly by compressing the top edge 11 and the bottom edge 12 with the fingers and thumb of the other hand, as shown in FIG. 4. The user thus can readily grasp extension tab 28 and detach the mated first tear strip 29 and the second tear strip 57, thus opening the envelope. Secondly, when the closure flap 50 is rotated upwardly the contents of the envelope are partly exposed, thus permitting their ready removal.

To fulfill these purposes, the extension tab 28 and the end 58 may be located closer to the top edge 11 or to the bottom edge 12 of the front panel 10 as long as they are not closer to the edges 11 or 12 than about one quarter of the vertical distance between the edges 11 and 12. Thus, the top edge 11 of the front panel 10 may extend above the top edge 21 of the back panel 20 on the first side edge 23 of the back panel 20 by a distance in the range of about three times to about one third of the height of the back panel 20 when the back panel 20 is adhesively fastened to the first side flap 30 and the second side flap 40.

Figure 3:
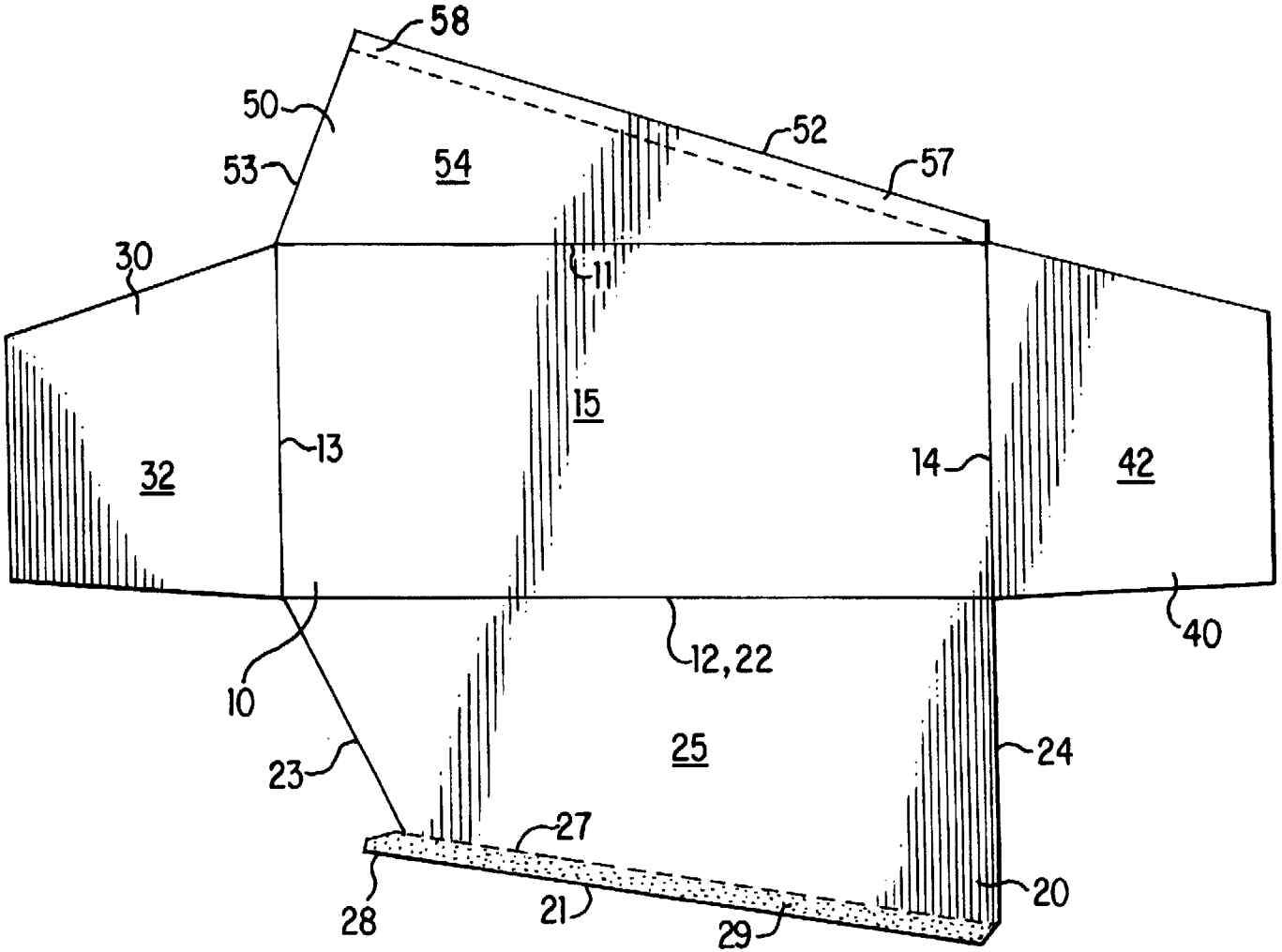
FIG. 3 is a plan view of a blank for forming the same preferred embodiment of the subject envelope.

FIG. 3 shows the blank from which envelope 5 is formed, showing the inner surfaces 15, 25, 32, 42, and 54 of the front panel 10, the back panel 20, the first side flap 30, the second side flap 40, and the closure flap 50, respectively. As noted earlier, the second side flap 40 may be omitted, in which case the back panel 20 may be adhered directly to the front panel 10 along their second side edges 14 and 24, respectively.

In the preferred embodiment of the invention shown in FIGS. 1–3, the interior surface of the first tear strip 29 is provided with adhesive for closing the envelope. Alternatively, the adhesive could be provided on the outer surface of the first tear strip 29, on the inner surface of the second tear strip 57 or on the inner surface of the second tear strip 57 or on various combinations, such as the inner surface of the first tear strip 29 and the outer surface of the second tear strip 57.

The side edge 23 of the back panel 20 and the side edge 53 of the closure flap 50 slant inwardly away from the first side edge 13 of the front panel (see FIGS. 1 and 2) for the purpose of recessing the extension tab 28 and preventing it from being caught or engaged by another object during the mailing process. The amount of slant of the first side edge 23 of the back panel 20 and the side edge 53 of the closure flap 50 may be varied as considered necessary or useful from the standpoints of utility and attractiveness. Preferably, the combination of the back panel 28, the other side flap 30, second side flap 40 and closure flap 50 should completely enclose the back side of the envelope 5 when the envelope 5 is sealed, in order to prevent any unauthorized viewing of the contents or the loss these contents during mailing.

FIGS. *5a–5i* show back views of various alternative embodiments of the envelope of the invention having constructions generally the same as that of the embodiment shown in FIGS. 1–4 but with variations in the structure of the back panel and closure flap.

FIG. *5a* shows an embodiment in which the top edge of the back panel 20 and the sealing edge of the closure flap 50 are parallel to the top edge and bottom edge of the front panel. The back panel 20 of this embodiment overlaps the closure flap 50.

FIG. *5b* shows an embodiment in which the side edge 53 of the closure flap 50 is more slanted than the first side edge 23 of the back panel 20 in order to facilitate access to the extension tab 28. The back panel 20 of this embodiment overlaps the closure flap 50.

FIG. *5c* shows an embodiment in which the extension tab 28 extends upwardly along the side edge of the closure flap 50 rather than directly toward the first side edge of the front panel. The back panel 20 of this embodiment overlaps the closure flap 50.

FIG. *5d* shows an embodiment in which the extension tab 28 is indented at its intersection with the first side edge 23 of the back panel 20 in order to facilitate access to that extension tab. The back panel 20 of this embodiment overlaps the closure flap 50.

FIG. *5e* shows another embodiment having a downwardly slanted extension tab 28. The closure flap 50 of this embodiment overlaps the back panel 20.

FIG. *5f* shows an embodiment in which the extension tab 28 is formed by cutting into the first side edge 23 of the back panel 20. The back panel 20 of this embodiment overlaps the closure flap 50.

FIGS. *5g* and *5h* show embodiments in which a tear strip 62 is formed in the closure flap 50 (FIG. *5g*) or a tear strip 64 is formed in the back panel 20 (FIG. *5h*) by two parallel lines of perforations formed in the back panel 20 or in the closure flap 50, respectively. The extension tabs 66 and 68 are located no closer to the top edge 11 or the bottom edge 12 of the front panel 10 than about one quarter of the vertical distance between the top edge 11 and the bottom edge 12 of the front panel 10 and preferably are located about half way between the top edge 11 and the bottom edge 12 of the front panel 10, as shown and explained in connection with the embodiment of FIGS. 1–4.

The closure flap 50 of the embodiment shown in FIG. *5g* is overlapped by the back panel 20 whereas in the embodiment of FIG. *5h* the closure flap 50 overlaps the back panel 20.

FIG. *5i* shows an embodiment in which the sealing edge 52 of the closure flap 50 slants downwardly from the extension tab 28 rather than upwardly as in the embodiment shown in FIGS. 1–4. The closure flap 50 also overlaps the back panel 20.

While the invention has been described in detail with respect to certain and preferred embodiments, it should be understood that the invention is not limited to those precise embodiments, and that those embodiments are instead representative examples of the many modifications and variations which present themselves to those skilled in the art to which the invention pertains without departing from the scope and spirit of this invention, as defined in the appended claims.

What is claimed is:

1. An easy-opening envelope comprising:

(a) a substantially rectangular planar front panel having opposed inner and outer surfaces, a top edge, a bottom edge, and first and second opposed side edges;

(b) a back panel having opposed inner and outer surfaces, a bottom edge, a top edge, and first and second opposed side edges adjacent, respectively, to the first and second side edges of the front panel, the bottom edge of the back panel being hingedly connected to the bottom edge of the front panel, the back panel having a line of perforations traversing the back panel between an intersection of the line of perforations with the first side edge of the back panel and an intersection of the line of perforations with the second side edge of the back panel, thereby forming a first tear strip in the back panel above the line of perforations in the back panel; and (a) a closure flap having opposed inner and outer surfaces, a side edge adjacent the first side edge of the front panel, a top edge hingedly connected to the top edge of the front panel, a sealing edge, and the closure flap having a line of perforations traversing the closure flap, thereby forming a second tear strip in the closure flap below the line of perforations in the closure flap, the line of perforations being substantially coincident with or above the top edge of the back panel when the closure flap is in sealing engagement with the back panel, the distance from the top edge of the closure flap to the sealing edge of the closure flap being such that the first tear strip may be sealed to the second strip, the first and second tear strips thereby forming a mated tear strip for opening the envelope after sealing; and at least one of the first and second tear strips having an integral pull-tab extending past the first side edge of the back panel and the side edge of the closure flap, respectively, the integral pull-tab being no closer to the top edge of the front panel and to the bottom edge of the front panel than about one quarter of the height of the front panel, and the first side edge of the back panel and the side edge of the closure flap slanting away from the first side edge of the front panel in order for the pull-tab to be spaced inwardly and thus apart from the first side edge of the front panel, so that when the envelope is bent so that the envelope is convex toward the closure flap and the back panel, the pull-tab may be easily grasped in order to detach the mated tear strip and thus easily open the envelope.

2. The envelope according to claim 1 further comprising a first side flap hingedly connected to the first side edge of the front panel, the first side flap having an inner and an outer surface, the inner surface of the first side flap being adjacent the inner surface of the front panel, and at least a portion of the outer surface of the first side flap being adhesively attached to the inner surface of the back panel.

3. The envelope according to claim 2 further comprising a second side flap hingedly connected to the second side edge of the front panel, the second side flap having an inner and outer surface, the inner surface of the second side flap being adjacent the inner surface of the front panel, and at least a portion of the outer surface of the second side flap being adhesively attached to the inner surface of the back panel.

4. The envelope according to claim 1 in which the lines of perforations in the back panel and in the closure flap are severed inwardly from their ends adjacent the first side edge of the back panel and the side edge of the closure flap, respectively.

5. The envelope according to claim 1 in which the pull-tab is located about half-way between the top edge and the bottom edge of the front panel.

6. The envelope according to claim 1 in which the sealing edge of the closure flap is substantially parallel to the top edge of the back panel when the closure flap is in sealing engagement with the back panel and the top edge of the back panel slants upward from its intersection with the first side edge of the back panel.

7. The envelope according to claim 1 in which the sealing edge of the closure flap is substantially parallel to the top edge of the back panel when the closure flap is in sealing engagement with the back panel and the top edge of the back panel slants downward from its intersection with the first side edge of the back panel.

8. The envelope according to claim 1 in which the sealing edge of the closure flap is substantially parallel to the top edge of the back panel when the closure flap is in sealing engagement with the back panel and the top edge of the back panel is substantially parallel to the bottom edge of the back panel.

9. The envelope according to claim 1 further comprising an adhesive area containing adhesive disposed on the inner surface of the second tear strip.

10. The envelope according to claim 1 further comprising an adhesive area containing adhesive disposed on the outer surface of the first tear strip.

11. The envelope according to claim 1 further comprising an adhesive area containing adhesive disposed on the inner surface of the first tear strip.

12. The envelope according to claim 1 in which the line of perforations in the back panel is substantially parallel to and below the top edge of the back panel.

13. The envelope according to claim 1 in which the line of perforations in the closure flap is substantially parallel to the sealing edge.

14. An easy-opening envelope comprising:

(a) a substantially rectangular planar front panel having opposed inner and outer surfaces, a top edge, a bottom edge, and first and second opposed side edges;

(b) a back panel having opposed inner and outer surfaces, a bottom edge, a top edge, and first and second opposed side edges adjacent, respectively, to the first and second side edges of the front panel, the bottom edge of the back panel being hingedly connected to the bottom edge of the front panel, the back panel having two substantially parallel lines of perforations below the top edge of the panel and traversing the back panel from intersections of the lines of perforations with the first side edge of the back panel to intersections of the lines of perforations with the second side edge of the back panel, thereby forming a tear strip for opening the envelope after sealing, the tear strip having an integral pull-tab extending past the first side edge of the back panel, the pull-tab being no closer to the top edge and to the bottom edge of the front panel than about one quarter of the height of the front panel, and the first side edge of the back panel slanting away from the first side edge of the front panel so that the pull-tab is spaced inwardly and thus apart from the first side edge of the front panel;

(c) a closure flap having opposed inner and outer surfaces, a side edge adjacent the first side edge of the front panel, a top edge hingedly connected to the tope edge of the front panel, and a sealing edge, the distance from the top edge of the closure flap to the sealing edge of the closure flap being such that the closure flap may be sealed to the back panel above the tear strip in the back panel;

the pull-tab being thereby positioned so that it is easily grasped when the envelope is bent so that the envelope is convex toward the closure flap and the back panel, in order to detach the tear strip and thus easily open the envelope.

15. The envelope according to claim 14 further comprising a first side flap hingedly connected to the first side edge of the front panel, the first side flap having an inner and an outer surface, the inner surface of the first side flap being adjacent the inner surface of the front panel, and at least a portion of the outer surface of the first side flap being adhesively attached to the inner surface of the back panel.

16. The envelope according to claim 15 further comprising a second side flap hingedly connected to the second side edge of the front panel, the second side flap having an inner and outer surface, the inner surface of the second side flap being adjacent the inner surface of the front panel, and at least a portion of the outer surface of the second side flap being adhesively attached to the inner surface of the back panel.

17. The envelope according to claim 14 in which the pull-tab is located about halfway between the top edge and the bottom edge of the front panel.

18. The envelope according to claim 14 in which the lines of perforations in the back panel are severed inwardly from their ends intersecting the first side edge of the back panel.

19. The envelope according to claim 14 in which the sealing edge of the closure flap is substantially parallel to the top edge of the back panel when the closure flap is in sealing engagement with the back panel and the top edge of the back panel slants upward from its intersection with the first side edge of the back panel.

20. The envelope according to claim 14 in which the sealing edge of the closure flap is substantially parallel to the top edge of the back panel when the closure flap is in sealing engagement with the back panel and the top edge of the back panel slants downward from its intersection with the first side edge of the back panel.

21. The envelope according to claim 14 in which the sealing edge of the closure flap is substantially parallel to the top edge of the back panel when the closure flap is in sealing engagement with the back panel and the top edge of the back panel is substantially parallel to the bottom edge of the back panel.

22. An easy-opening envelope comprising:

(a) a substantially rectangular planar front panel having opposed inner and outer surfaces, a top edge, a bottom edge, and first and second opposed side edges;

(b) a back panel having opposed inner and outer surfaces, a bottom edge, a top edge, and first and second opposed side edges adjacent, respectively, to the first and second side edges of the front panel, the bottom edge of the back panel being hingedly connected to the bottom edge of the front panel; and (c) a closure flap having opposed inner and outer surfaces, a side edge adjacent the first side edge of the front panel, a top edge hingedly connected to the top edge of the front panel, and a sealing edge, the closure flap having two substantially parallel lines of perforations traversing the closure flap from intersections of the lines of perforations with the side edge of the closure flap, the lines of perforations being substantially parallel to the sealing edge of the closure flap and coincident with or above the top edge of the back panel when the closure flap is in sealing engagement with the back panel, thereby forming a tear strip for opening the envelope after sealing, the tear strip having an integral pull-tab extending past the side edge of the closure flap, the pull-tab being no closer to the top edge and to the bottom edge of the front panel than about one quarter of the height of the front panel, and the side edge of the closure flap slanting away from the first side edge of the front panel so that the pull-tab is spaced inwardly and thus apart from the first side edge of the front panel, so that when the envelope is bent so that the envelope is convex toward the closure flap and the back panel, the pull-tab may be easily grasped in order to detach the tear strip and thus easily open the envelope.

23. The envelope according to claim 22 further comprising a first side flap hingedly connected to the first side edge of the front panel, the first side flap having an inner and an outer surface, the inner surface of the first side flap being adjacent the inner surface of the front panel, and at least a portion of the outer surface of the first side flap being adhesively attached to the inner surface of the back panel.

24. The envelope according to claim 23 further comprising a second side flap hingedly connected to the second side edge of the front panel, the second side flap having an inner and outer surface, the inner surface of the second side flap being adjacent the inner surface of the front panel, and at least a portion of the outer surface of the second side flap being adhesively attached to the inner surface of the back panel.

25. The envelope according to claim 22 in which the pull-tab is located about halfway between the top edge and the bottom edge of the front panel.

26. The envelope according to claim 22 in which the lines of perforations in the closure flap are severed inwardly from their ends intersecting the side edge of the closure flap.

27. The envelope according to claim 22 in which the sealing edge of the closure flap is substantially parallel to the top edge of the back panel when the closure flap is in sealing engagement with the back panel and the top edge of the back panel slants upward from its intersection with the first side edge of the back panel.

28. The envelope according to claim 22 in which the sealing edge of the closure flap is substantially parallel to the top edge of the back panel when the closure flap is in sealing engagement with the back panel and the top edge of the back panel slants downward from its intersection with the first side edge of the back panel.

29. The envelope according to claim 22 in which the sealing edge of the closure flap is substantially parallel to the top edge of the back panel when the closure flap is in sealing engagement with the back panel and the top edge of the back panel is substantially parallel to the bottom edge of the back panel.

* * * * *